US006123484A

United States Patent [19]

Fujita

[11] Patent Number: 6,123,484

[45] Date of Patent: Sep. 26, 2000

[54] SOIL PILE AND METHOD FOR CONSTRUCTING THE SAME

[76] Inventor: Takatoyo Fujita, 9-11, Naritahigashi 1-chome, Suginami-ku, Tokyo, Japan

[21] Appl. No.: 09/014,616

[22] Filed: Jan. 28, 1998

[30] Foreign Application Priority Data

| | | | |
|---|---|---|---|
| Jan. 29, 1997 | [JP] | Japan | 9-029772 |
| Feb. 3, 1997 | [JP] | Japan | 9-034369 |
| Oct. 27, 1997 | [JP] | Japan | 9-311429 |

[51] Int. Cl.[7] ..... E02D 5/30

[52] U.S. Cl. ..... 405/233; 405/266; 405/267

[58] Field of Search ..... 405/233, 236, 405/237, 238, 239, 240, 241, 242, 243, 266, 267

[56] References Cited

U.S. PATENT DOCUMENTS

| | | | |
|---|---|---|---|
| 3,783,624 | 1/1974 | Nakade et al. | 405/264 |
| 4,065,928 | 1/1978 | Takagi et al. | 405/267 |
| 4,815,860 | 3/1989 | Deuse | 366/3 |
| 4,832,535 | 5/1989 | Crambes | 405/266 |
| 4,886,400 | 12/1989 | Taki et al. | 405/267 |
| 5,002,438 | 3/1991 | Strong | 405/303 |
| 5,098,481 | 3/1992 | Monlux | 134/19 |
| 5,118,223 | 6/1992 | Taki | 405/267 |
| 5,263,797 | 11/1993 | Lindstrom et al. | 405/266 |
| 5,304,016 | 4/1994 | Kunito | 405/233 |
| 5,417,522 | 5/1995 | Kono et al. | 405/266 |
| 5,645,376 | 7/1997 | Taki | 405/241 |
| 5,722,800 | 3/1998 | Esters | 405/267 |
| 5,776,244 | 7/1998 | Ahrens | 106/737 |
| 5,820,302 | 10/1998 | Roberts et al. | 405/266 X |

*Primary Examiner*—Eileen D. Lillis
*Assistant Examiner*—Jong-Suk Lee
*Attorney, Agent, or Firm*—Michael D. Bednarek; Shawpittman

[57] ABSTRACT

The present invention provides a soil pile and method for constructing same that uses a stirred mixture that includes excess stirred mixture resulting from a prior construction, e.g., a prior soil pile construction. The stirred mixture is composed of consolidation agents and earth/sand. Water can be added to the stirred mixture so that it is easier to pump. Additional amounts of consolidation agents can be added to the stirred mixture to increase the strength of the soil pile. The stirred mixture is pumped into a borehole either as the hole is bored or after the hole is bored and earth/sand is removed. The stirred mixture can also be dried and pulverized before being used for the soil pile of the present invention.

8 Claims, 4 Drawing Sheets

SOIL PILE AND METHOD FOR CONSTRUCTING THE SAME

BACKGROUND OF THE INVENTION

In the foundation work for rebuilding of structures including buildings, in order to prevent an influence on adjacent lands and/or buildings and further to stop water in the ground, diaphragm walls have been constructed in the vicinity of the boundary of adjacent lands.

The present invention relates to a soil pile, method for constructing the soil pile and material for the same in the cast in place soil pile wall which is one of methods for construction of diaphragm walls.

In accordance with a conventional method for the cast in place soil pile walls, diaphragm walls are constructed in such a manner that, while boring is being carried out along a construction line of the diaphragm walls using an auger machine, consolidation agents such as cement, bentonite and the like and the admixture and its mixture with water to be added when necessary, are together jetted from the tip of a screw of the auger machine which are subsequently stirred and mixed with earth/sand, and then said screw is pulled out to form and fix soil piles in the ground comprising consolidation agents such as said cement, bentonite, etc., admixture, water and earth/sand and finally the said soil piles are overlapped and consecutively set.

Accordingly, theoretically, said consolidation agents such as cement, bentonite, and the like to be added when soil piles are constructed, the admixture to be added when necessary (hereinafter as merely "consolidation agents and the like"), the mixtures obtained by stirring and mixing said consolidation agents and the like with the earth/sand (hereinafter as "stirred mixture") and water are discharged out onto the ground.

Actually, because the added consolidation agents and the like and part of water permeate the surrounding earth bed, it does not occur that all of these are discharged onto the ground. However, many soil piles to serve as soil pile walls are constructed, a great deal of said stirred mixture is discharged onto the ground.

Because said stirred mixture discharged on the ground when said soil piles are constructed may cause the destruction of nature if they are disposed of as they are, it has been mandatory to treat such a mixture as industrial waste which has to be subject to the law when disposed of.

It is, however, a present state that the cost of said waste disposal, because it is very high, forms much proportion of the total expenditure of construction work.

That is, the said stirred mixture discharged onto the ground, after stored temporarily at a reservoir site, has been transported by dump trucks of disposal expert businessmen to a waste disposal site for final disposal. However, there have been various problems that such high costs of the waste disposal has induced unlawful disposal of waste, causing the destruction of nature.

SUMMARY OF THE INVENTION

The present invention has been made to solve said various problems and it is thereto an object of the present invention to provide a soil pile, its construction method and material for the same by reusing said stirred mixture for the construction of the soil pile, thereby reducing the amount of said stirred mixture to be disposed of as waste and the costs of waste disposal as well as saving said consolidation agents and, as a result, achieving the reduction of a total construction work costs.

In claim 1 of the present invention, a soil pile is provided which comprises said stirred mixture discharged when the soil pile is constructed, consisting of said consolidation agents and the like (consolidation agents such as cement, bentonite, etc., and admixture to be added when necessary) and earth/sand. The soil pile defined in claim 1 is concretely constructed by a method defined in claim 3 to be described later.

In claim 2 of the present invention, a soil pile is provided which contains part of said stirred mixture discharged when the soil pile is constructed. The soil pile defined in claim 2 is concretely constructed by a method defined in claim 4 to be described later.

In claim 3 of the present invention, a method of constructing the soil pile is provided which is characterized in that the soil pile is struck and fixed in the ground while a specified amount of water is being added to said stirred mixture discharged on the ground when the soil pile is constructed, i.e., to the mixture obtained by stirring and mixing said consolidation agents and the like with said earth/sand.

In this method of constructing the soil pile, the soil pile is struck in the ground and fixed while a specified amount of water is being added to said stirred mixture to be in flux.

In claim 4 of the present invention, a method of constructing the soil pile is provided which is characterized in that, when it is difficult to strike the soil pile having required strength therein if said stirred mixture discharged at the time of constructing of the soil pile only, i.e., mixture obtained by stirring and mixing said consolidation agents with earth/sand only are used, the soil pile is struck and fixed in the ground while additional consolidation agents and the like and water are newly supplied.

In claim 5 of the present invention, a material for the soil pile is provided which comprises dried and pulverized mixture of said consolidation agents with said earth/sand discharged at the time of the construction of the soil pile. Either drying by heating or air drying can be used and a grinder is adapted to pulverize them. Thus, drying and pulverizing of said stirred mixture allow easy storage, transportation and other handling.

In claim 6 of the present invention, a method of constructing the soil pile is provided wherein the soil pile is struck and fixed in the ground while a specified amount of water is added to the material for the soil pile composed of dried and pulverized mixture of said consolidation agents with said earth/sand discharged at the time of the construction of the soil pile and which corresponds to the construction method defined in claim 3.

In claim 7 of the present invention, a method of constructing the soil pile is provided which is characterized in that, when it is difficult to strike and fix in the ground the soil pile having required strength therein if a material for the soil pile composed of dried and pulverized mixture obtained by stirring and mixing said consolidation agents with said earth/sand discharged at the time of constructing of the soil pile only are used, the soil pile is struck and fixed in the ground while additional consolidation agents and the like and water are newly supplied and which corresponds to the construction method defined in claim 4.

DETAILED DESCRIPTION OF THE INVENTION

In the soil pile, a mixing ratio of cement to said consolidation agent and to water varies depending on soil properties in site and, for example, in the case of viscous soil, the mixture consists of about 300 to 450 kilograms of cement, about 5 to 15 kilograms of bentonite and about 450 to 900 liters of water per cubic meter.

Moreover, in the case of sand soil, the mixture consists of about 200 to 400 kilograms, about 5 to 20 kilograms of ventonite and about 300 to 800 liters of water per cubic meter. In the case of sand and conglomerate soil, the mixture consists of about 200 to 400 kilograms, about 5 to 30 kilograms and about 300 to 800 liters per cubic meter. If necessary, an admixture and the like may be added.

The said stirred mixture discharged onto the ground at the time of the construction of the soil pile have contained sufficient amount of composition of consolidation agents and the like for soil pile construction; however, this have conventionally been disposed of at cost.

Figure 1:
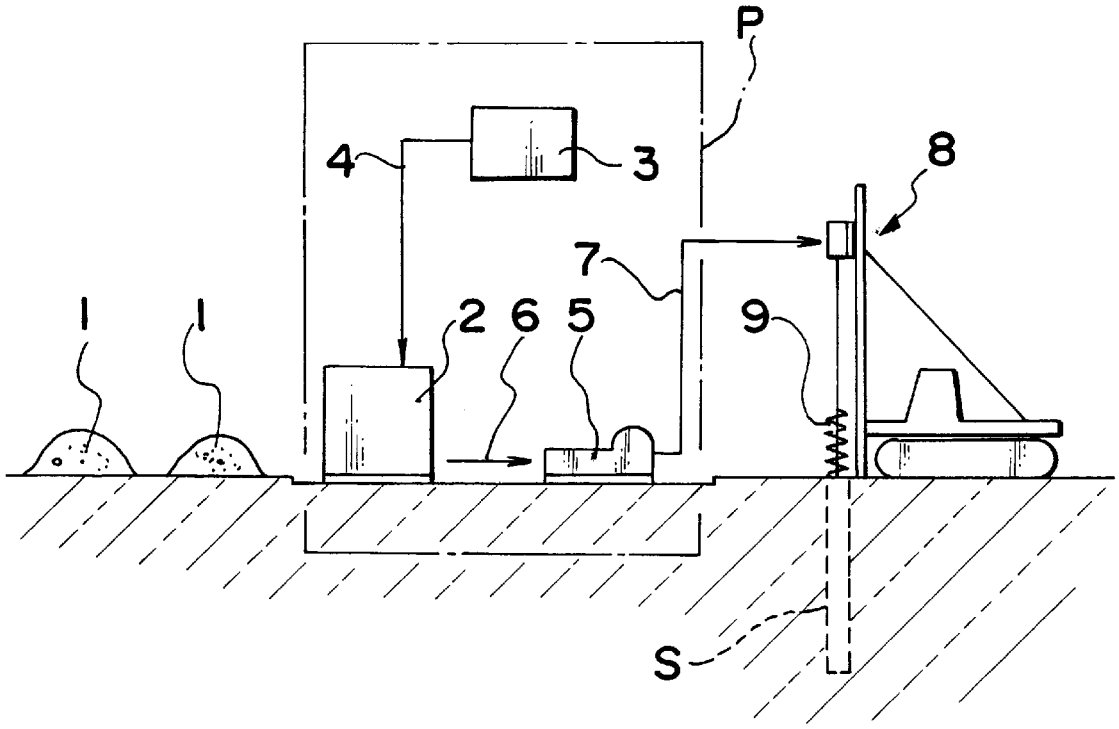
FIG. 1 is a schematic view illustrating one example of a soil pile and equipment carrying out a method of constructing soil pile of the present invention.

Referring to FIG. 1, the reference numeral 1 is the mixture obtained by stirring and mixing consolidation agents and the like with earth/sand discharged onto the ground and water.

The reference numeral 2 is a mud adjusting tank into which said stirred mixture is put and which is equipped with an appropriate agitating blade (not shown) therein and is so configured that water is supplied freely. In the figure showing an embodiment of the present invention, the water tank 3 is connected to the mud adjusting tank via a water supply pipe 4 and a required amount of water can be supplied when necessary to said mud adjusting tank 2.

When the viscosity of said stirred mixture 1 put in the mud adjusting tank 2 is high and its transportation via a forced feed pump is impossible or difficult, the water tank 3 serves to supply water into said mud adjusting tank 2 which is used to agitate the stirred mixture to reduce its viscosity, thereby allowing them to be transported through the forced feed pump and the like.

The reference numeral 5 is a forced feed pump connected to a pipe line 6 extended from said mud adjusting tank 2, which is used to supply the stirred mixture 1 in the mud adjusting tank 2 through a pipe line 7 to an auger machine 8. In FIG. 1, said mud adjusting tank 2, water tank 3, water supply pipe line 4, forced feed pump 5, pipe lines 6 and 7 are shown as a block separately and respectively, however, actually these components constitute one plant P.

As described above, the stirred mixture 1 supplied to the auger machine 8 is jetted from the screw head immediately after completion of boring by a screw 9 and a soil pile S is formed when said screw 9 is pulled out from the ground. The soil pile S formed therein is mainly composed of a mixture of said consolidation agents with earth/sand discharged on the ground at the time of the construction of the soil pile, i.e., said stirred mixture.

Moreover, in said embodiment, there may be cases where the soil pile having required strength cannot be obtained due to short amount of said consolidation agents caused by the addition of earth/sand from the ground in site to said stirred mixture 1 discharged on the ground.

Such a situation as described above is anticipated, prior to the construction of the soil pile, boring is carried out in the ground in site to discharge the earth/sand onto the ground to reduce the amount of the earth/sand existing in the bored area, the soil pile is then formed by the said method.

Figure 2:
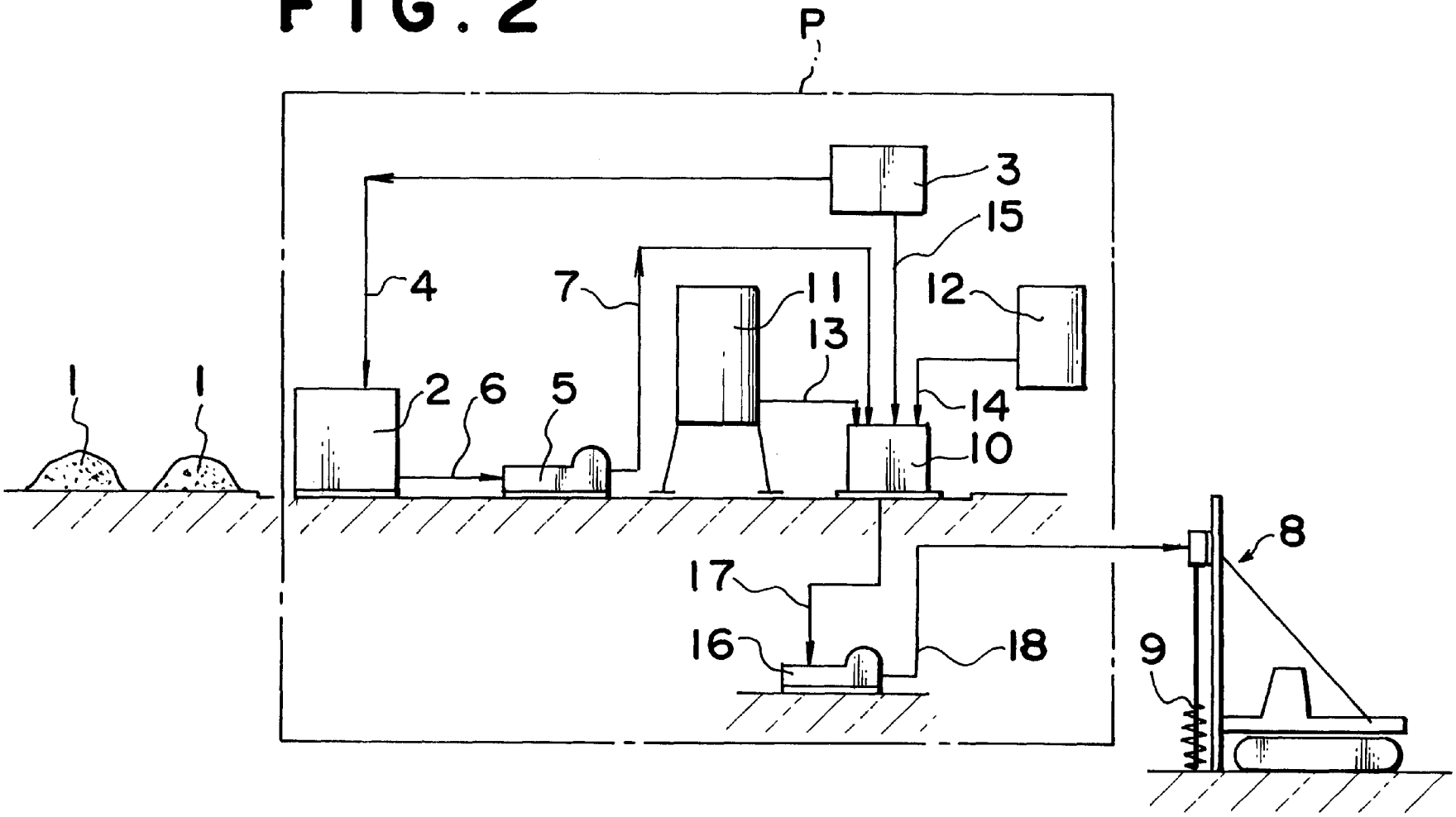
FIG. 2 is a schematic view illustrating one embodiment of the soil pile and a method for constructing soil pile of the present invention.

Referring to FIG. 2, the configuration in this embodiment is effective when the soil pile having required strength cannot be obtained as one shown in FIG. 1, wherein the mud adjusting tank 2, water tank 3, water supply pipe line 4, forced feed pump 5, pipe lines 6 and 7 are all connected to a mixer 10, not directly to an auger machine 8.

Additionally, to this mixer 10, said consolidation agents and the like and water are supplied freely. A cement silo 11 and bentonite silo 12 are positioned in proximity to said mixer 10 to which a cement supply pipe 13 and bentonite supply pipe 14 are connected respectively so that the specified amount of consolidation agents such as cement and bentonite can be supplied to said mixer 10. The reference numeral 15 is a water supply pipe which is extended from said water tank 3 and connected to the mixer 10.

The soil cement is prepared by adding the amount of said consolidation agent and the like required to obtain necessary strength to said stirred mixture supplied via the forced feed pump 10 from the mud adjusting tank 2.

The soil cement prepared by said mixer 10 is transferred via a pipe line 17, forced feed pump 16 and pipe line 18 to an auger machine 8 and is jetted from the screw head at the same time when boring is carried out by a screw 9 to form a soil pile in the same manner as shown in FIG. 1.

In FIG. 2, the mud adjusting tank 2, water tank 3, water supply pipe line 4, forced feed pump 5, pipe lines 6 and 7, mixer 10, cement silo 11, bentonite silo 12, cement supply pipe line 13, bentonite supply pipe line 14, water supply pipe line 15, forced feed pump 16, pipe lines 17 and 18 are respectively shown as a separate block, however, actually they constitutes one plant.

The soil pile constructed by the method described above is formed by adding the consolidation agents the amount of which is less than that used when the soil pile is constructed by the conventional method to the stirred mixture discharged at the construction of other soil piles and, as a result, the amount of consolidation agents such as cement and bentonite, etc., can be saved.

As described above, when the soil pipe wall is completed finally, the amount of the stirred mixture discharged on the ground and to be disposed of is theoretically equal to that discharged at the time of the construction of the final soil piles, thus making very low the cost of waste disposal.

Figure 3:
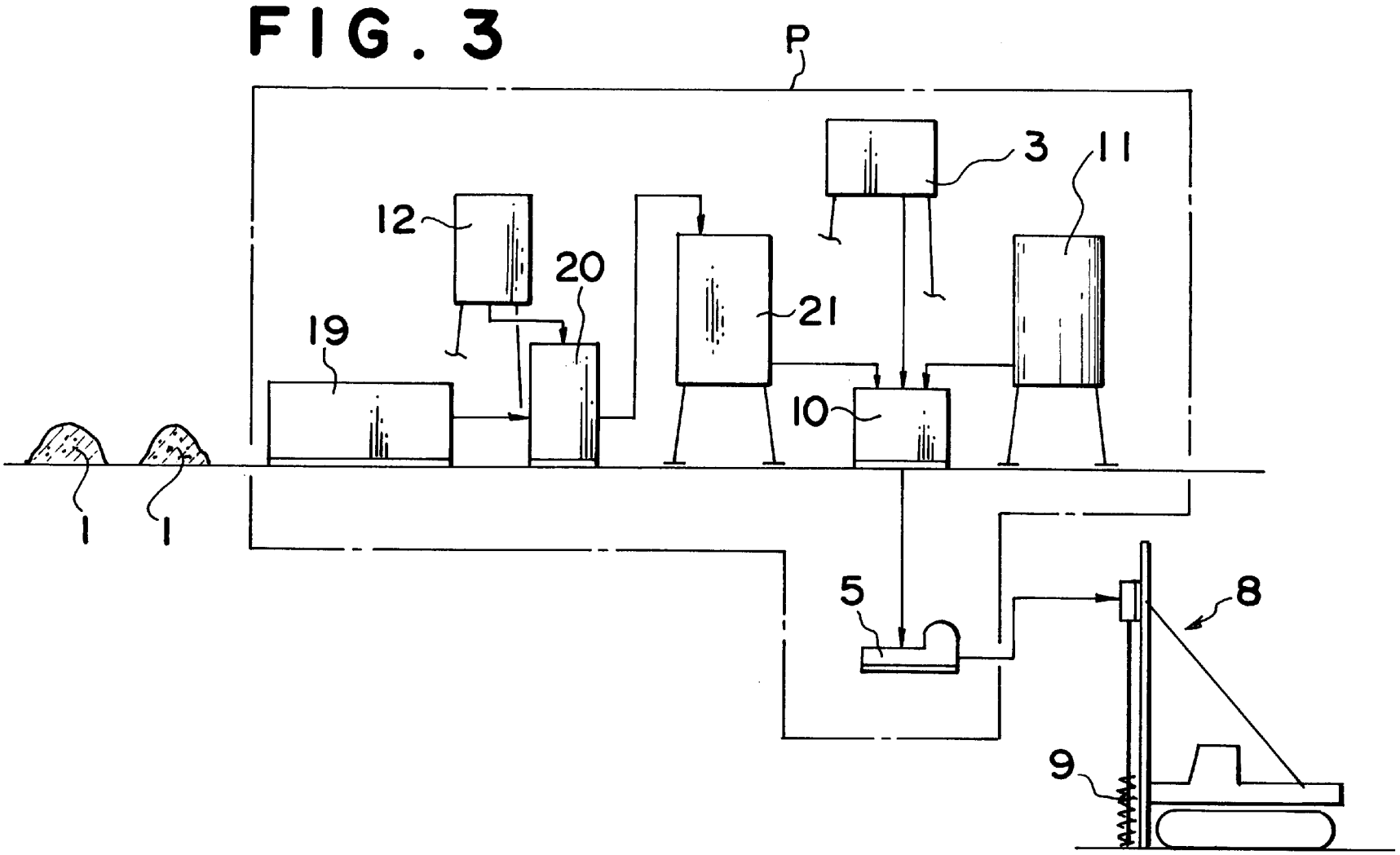
FIG. 3 is a schematic view illustrating equipment for drying and pulverizing a mixture obtained by stirring and mixing consolidation agents and the like with earth/sand discharged at the time of constructing a soil pile and equipment carrying out a method of constructing a soil pile using a material for a soil pile.
Figure 4:
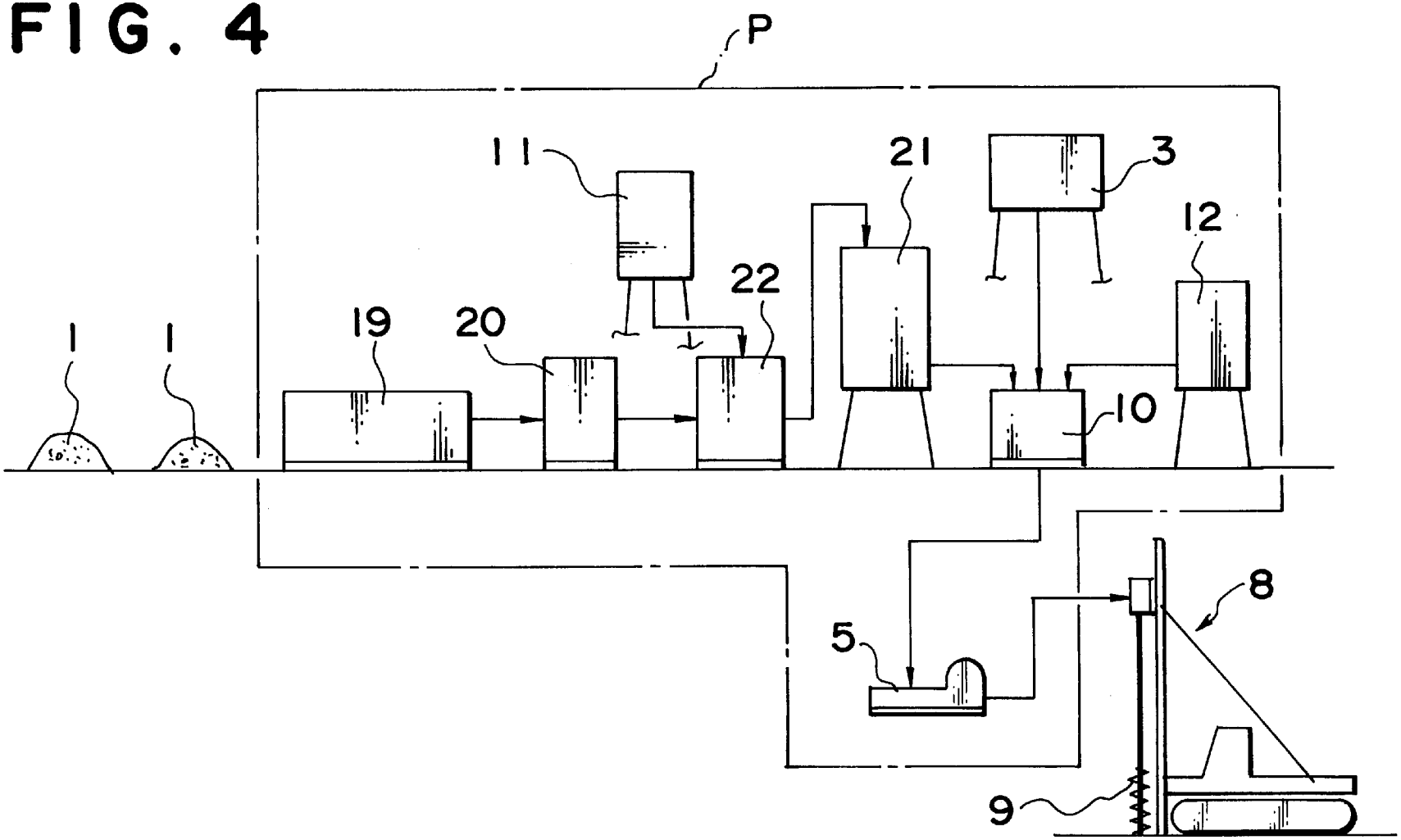
FIG. 4 is a schematic view illustrating equipment for drying and pulverizing a mixture obtained by stirring and mixing consolidation agents and the like with earth/sand discharged at the time of constructing a soil pile and equipment carrying out a method of constructing a soil pile using such a pulverized material for a soil pile.

FIGS. 3 and 4 show a method for producing a material for a soil pile and for constructing a soil pile using said material for the soil pile according to the present invention.

The reference numeral 1 in FIGS. 3 and 4 is said stirred mixture discharged onto the ground when soil piles are constructed and part of water contained in the mixture was removed to some extent when the mixture is discharged on the ground.

The reference numeral 19 in FIGS. 3 and 4 is a drying machine to which said mixture is fed when a heating means is provided (not shown) to be used to evaporate and remove an adequate amount of water contained in the stirred mixture by hot blast, radiation heat or direct heat. Also, an adequate amount of water may be evaporated by air seasoning.

Preferably, in the process of drying, the mixture is dried to that it does not evaporate all of water contained in said mixture but it contains a slight amount of water, which serves to avoid a decrease in subsequent consolidation activity.

Prior to or after said drying process, a big solid such as a stone is removed if necessary.

The material for the soil pile of the present invention can be obtained by pulverizing the mixture with a grinder 20 after said drying process. The material for the soil pile obtained here are composed of said stirred mixture 1, i.e., consolidation agents and the like and said earth/sand, which has a function of soil cement.

The material for the soil pile obtained by the method described above can be used for striking and fixing the soil pile in the ground by adding a specified amount of water, for example, via the equipment shown in FIG. 1.

There may be cases where required strength in the soil pile can not be obtained due to reduction of consolidation action caused by dilution and mixing with earth/sand in the ground in site, which depends on the nature of the earth/sand in the ground in site.

If such a situation is anticipated, after discharging and reducing the amount of earth/sand by boring in the ground in site prior to the construction of the soil pile, the soil pile is then constructed by injecting the mixture of material for the soil pile with water into the bored area.

Referring to FIG. 3, a specified amount of bentonite is supplied from a bentonite site 12 at the time of pulverization to the material for the soil pile produced by said grinder 20 and their mixed powder is stored in a powder silo 21.

The mixed powder consisting of said material for the soil pile and bentonite is supplied from said powder silo 21 to a mixer 10 to which a specified amount of cement and water are further supplied from the cement silo 11 and water tank 3, and soil cement is produced in the mixer 10 for use in the construction of the soil pile.

Then, the soil produced by the mixer 10 is conveyed via a forced feed pump 5 to an auger machine 8 and is jetted from the screw head at the same time when boring is carried out by a screw 9 to form a soil pile.

The soil pile constructed therein is composed of said stirred mixture discharged at the time of the construction of said soil pile, consolidation agents including a specified amount of cement and bentonite, etc., water and earth/sand in the ground in site.

Embodiment shown in FIG. 4 is the same as that in FIG. 3, with the exception that mixing equipment 22 is provided next to said grinder 20 and that the time for supplying and mixing cement and bentonite is different.

A specified amount of cement is supplied to the mixing equipment 22 positioned next to the grinder 20 from a cement silo 11 and mixed and mixed powder is stored in a powder silo 21.

A specified amount of mixed powder containing said soil pile materials and cement is supplied from said powder silo 21 to a mixer 10 to which a specified amount of bentonite and water is supplied from the bentonite silo 12 and water tank 3 and soil cement is produced by the mixer 10 for use in the construction of the soil piles.

The soil cement produced in the mixer 10 is conveyed via a forced feed pump 5 to an auger machine 8 and is then jetted from the screw head at the same time when boring by a screw 9 is carried out in the same manner as in said FIG. 3 to construct a soil pile. The composition of the soil pile constructed by the equipment shown in FIG. 4 is the same as that constructed by the equipment shown in FIG. 3.

In FIGS. 3 and 4, the mud adjusting tank 2, grinder 20, bentonite silo 12, powder silo 21, mixer 10, cement silo 11, water tank 3, forced feed pump 5, mixing equipment 22 are respectively shown as a block, however, actually they constitute one plant P.

In the soil pile, the method for constructing the soil pile and materials for the soil pile of the present invention, the stirred mixture of consolidation agents and the like with earth/sand discharged at the time of the construction of the soil pile can be reused, which can reduce the amount and cost of waste disposal on the one hand and which can save the amount of consolidation agents such as cement, bentonite, etc. on the other hand, serving to reduce the construction cost and to be economical.

What is claimed is:

1. A method for constructing a second soil pile from recycled material obtained from prior soil pile constructions comprising the steps of:

(a) constructing a first soil pile with a stirred mixture, wherein the process of constructing the first soil pile produces an excess stirred mixture made of consolidation agents and earth/sand;

(b) preparing a second stirred mixture by adding water to the excess stirred mixture;

(c) boring into a ground to form a bore; and (d) placing the second stirred mixture into the bore to form the second soil pile.

2. The method of claim 1, wherein the step of boring into the ground and the step of placing the second stirred mixture occur concurrently.

3. The method of claim 1 wherein the step of constructing the first soil pile further comprises drying and pulverizing the excess stirred mixture.

4. A method for constructing a soil pile from recycled material obtained from prior soil pile constructions comprising the steps of:

(a) constructing an initial soil pile with a stirred mixture, wherein the constructing discharges an excess stirred mixture made of consolidation agents and earth/sand;

(b) preparing a second stirred mixture by adding water to the excess stirred mixture;

(c) boring a ground to form a bored area;

(d) removing bored soil from the bored area; and (e) placing the second stirred mixture into the bored area to form the soil pile.

5. The method of claim 4 wherein step (a) further comprises drying and pulverizing the excess stirred mixture.

6. A method for constructing a soil pile from recycled material from prior soil pile constructions comprising the steps of:

(a) constructing an initial soil pile with a stirred mixture, wherein the constructing discharges an excess stirred mixture made of consolidation agents and earth/sand;

(b) preparing a second stirred mixture by adding water and consolidation agents to the excess stirred mixture;

(c) boring a ground to form a bored area; and (d) placing the second stirred mixture into the bored area to form the soil pile.

7. A method for constructing a soil pile from recycled material obtained from prior soil pile constructions comprising the steps of:

(a) constructing an initial soil pile with a stirred mixture, wherein the constructing discharges an excess stirred mixture made of consolidation agents and earth/sand;

(b) drying and pulverizing the excess stirred mixture;

(c) preparing a second stirred mixture by adding a first additional amount of consolidation agents while pulverizing the excess stirred mixture;

(d) preparing a third stirred mixture by adding water and a second additional amount of consolidation agents to the second stirred mixture;

(d) boring a ground to form a bored area; and (e) placing the third stirred mixture into the bored area to form the soil pile.

8. A method for constructing a soil pile from recycled material obtained from prior soil pile constructions comprising the steps of:

(a) constructing an initial soil pile with a stirred mixture, wherein the constructing discharges an excess stirred mixture made of consolidation agents and earth/sand;

(b) drying and pulverizing the excess stirred mixture;

(c) preparing a second stirred mixture by mixing a first additional amount of consolidation agents with the excess stirred mixture after the excess stirred mixture is pulverized;

(d) preparing a third stirred mixture by adding water and a second additional amount of consolidation agents to the second stirred mixture;

(e) boring a ground to form a bored area; and (f) placing the third stirred mixture into the bored area to form the soil pile.

* * * * *